US011142992B1

(12) United States Patent
Faul et al.

(10) Patent No.: US 11,142,992 B1
(45) Date of Patent: Oct. 12, 2021

(54) PLUG RELEASE SYSTEM

(71) Applicants: Ryan Faul, Houston, TX (US); Marcelle H. Hedrick, Kingwood, TX (US); Joseph Ramirez, Houston, TX (US)

(72) Inventors: Ryan Faul, Houston, TX (US); Marcelle H. Hedrick, Kingwood, TX (US); Joseph Ramirez, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/015,193

(22) Filed: Sep. 9, 2020

(51) Int. Cl.
*E21B 33/16* (2006.01)

(52) U.S. Cl.
CPC ..... *E21B 33/165* (2020.05)

(58) Field of Classification Search
CPC ..... E21B 33/165; E21B 33/16; E21B 33/08
See application file for complete search history.

(56) References Cited

U.S. PATENT DOCUMENTS 3,915,226 A * 10/1975 Savage ..... E21B 33/16 166/153
4,317,486 A * 3/1982 Harris ..... E21B 33/05 166/113
5,293,933 A * 3/1994 Brisco ..... E21B 33/05 166/70
5,833,002 A * 11/1998 Holcombe ..... E21B 41/00 166/291
7,281,589 B2 * 10/2007 Robichaux ..... E21B 33/068 166/193
8,651,174 B2 * 2/2014 Barbee ..... E21B 34/02 166/70
9,115,562 B2 * 8/2015 Guidry ..... E21B 33/068
10,221,647 B2 * 3/2019 Rogozinski ..... E21B 33/14
2003/0024701 A1 * 2/2003 Simson ..... E21B 33/16 166/291
2011/0048712 A1 * 3/2011 Barbee ..... E21B 34/02 166/291
2015/0330181 A1 * 11/2015 Budde ..... E21B 33/16 166/289

* cited by examiner

*Primary Examiner* — Shane Bomar
(74) *Attorney, Agent, or Firm* — Cantor Colburn LLP

(57) ABSTRACT

A plug release system includes a tubular member having an outer surface and an inner surface defining a flow bore having a central longitudinal axis. A sleeve is positioned in the flow bore. The sleeve includes a first end having a radially outwardly extending annular lip, and a second end. A release mechanism is rotatably mounted in the tubular member radially offset from the central longitudinal axis. The release mechanism includes a sleeve support surface that selectively engages the radially extending annular lip. The release mechanism is rotatable between a first position wherein the sleeve maintains a plug in a retained configuration and a second position, wherein the sleeve releases the plug into the tubular member.

17 Claims, 8 Drawing Sheets

PLUG RELEASE SYSTEM

BACKGROUND

In the resource recovery industry, it can become necessary to drop a dart or plug into a tubular. The plug for example, can be used to initiate or clean internal surfaces of the tubular following, a cementing operation. Often times the plug is perched on a rod that bisects the tubular. The rod includes a support area for a plug support sleeve. Manipulation of the rod releases the sleeve which, in turn, launches the plug into the tubular. The support area currently has a small geometry that leads to an iterative assembly process and increased maintenance.

Thus, current designs not only require increased assembly time and complexity, the support surface is prone to mechanical wear and deformation after a limited number of operations. Without proper and frequent maintenance, the rod will not operate as designed to launch the plug. In addition to the need for frequent maintenance, current designs cannot provide an indication that the sleeve has shifted and the plug launched after the rod is manipulated. Accordingly, the industry would be open to a new launching system for plugs that requires less maintenance and may provide an indication of proper operation.

SUMMARY

Disclosed is a plug release system including a tubular member having an outer surface and an inner surface defining a flow bore having a central longitudinal axis. A sleeve is positioned in the flow bore. The sleeve includes a first end having a radially outwardly extending annular lip, and a second end. A release mechanism is rotatably mounted in the tubular member radially offset from the central longitudinal axis. The release mechanism includes a sleeve support surface that selectively engages the radially extending annular lip. The release mechanism is rotatable between a first position wherein the sleeve maintains a plug in a retained configuration and a second position, wherein the sleeve releases the plug into the tubular member.

Also disclosed is a resource exploration and recovery system including a surface system and a subsurface system including a tubular member string extending from the surface system. The tubular member string includes at least one tubular member having an outer surface and an inner surface defining a flow bore having a central longitudinal axis. A sleeve is positioned in the flow bore. The sleeve includes a first end having a radially outwardly extending annular lip, and a second end. A release mechanism is rotatably mounted in the tubular member radially offset from the central longitudinal axis. The release mechanism includes a sleeve support surface that selectively engages the radially extending annular lip. The release mechanism is rotatable between a first position wherein the sleeve maintains a plug in a retained configuration and a second position, wherein the sleeve releases the plug into the tubular member.

Still further disclosed is a method of releasing a plug into a tubular member string including manipulating a release mechanism to disengage a sleeve support surface from a radially outwardly extending annular lip on a sleeve positioned in a flow bore of a tubular member, releasing the sleeve to shift from a plug support position to a plug release position, and freeing a plug to pass into the tubular member string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
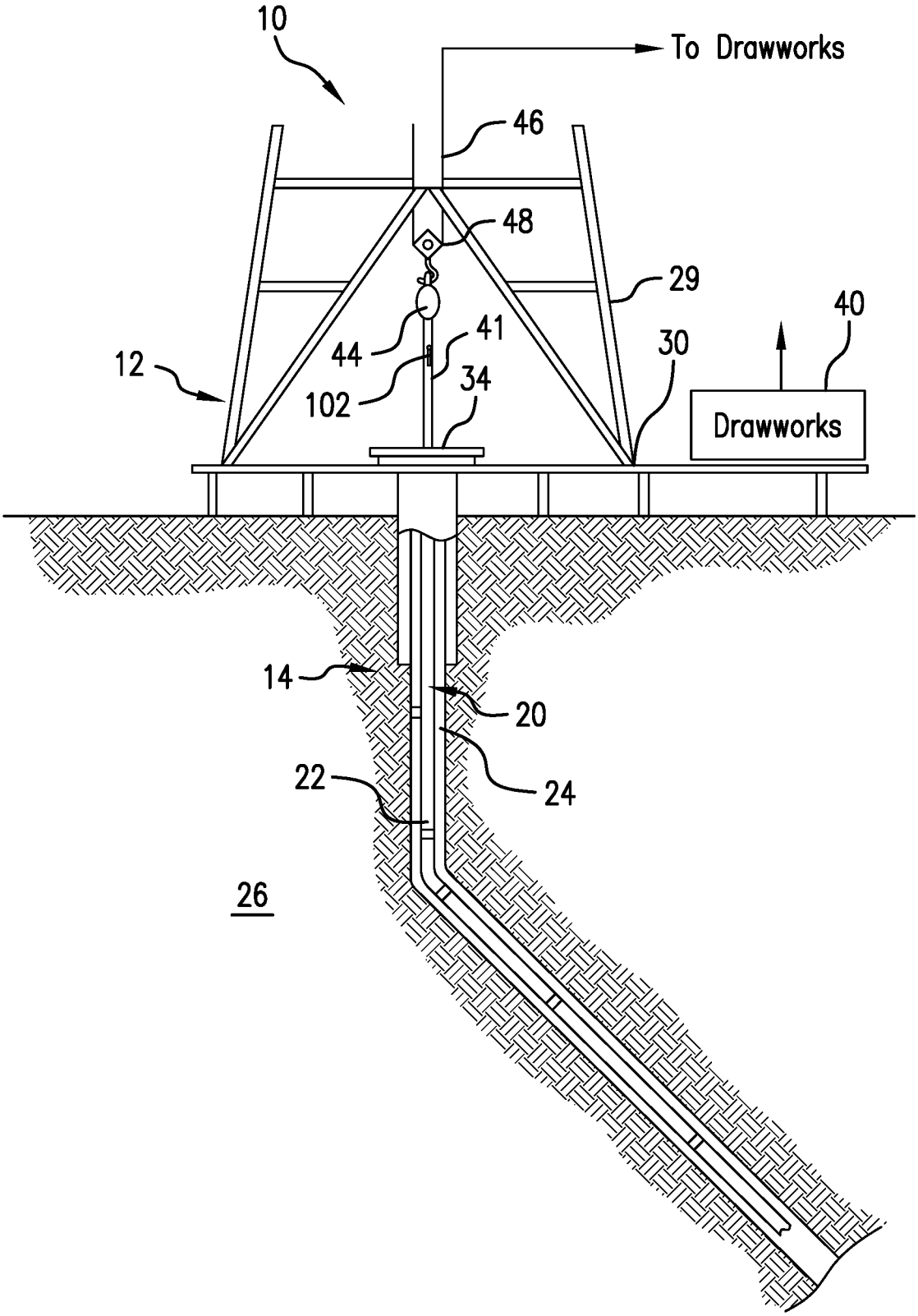
FIG. 1 depicts a resource exploration and recovery system including a plug release system, in accordance with an exemplary embodiment.

FIG. 1 shows a schematic diagram of a resource exploration and recovery system 10 for performing downhole operations. As shown, resource exploration and recovery system 10 includes a surface system 12 and a subsurface system 14 including a tubular string 20 formed from a plurality of tubular members 22 conveyed in a borehole 24 penetrating an earth formation 26. Surface system 12 includes a conventional derrick 29 erected on a floor 30 that supports a rotary table 34 that is rotated by a prime mover, such as an electric motor (not shown), at a desired rotational speed. Tubular string 20 extends downward from the rotary table 34 into the borehole 24. Tubular string 20 may be coupled to surface equipment such as systems for lifting, rotating, and/or pushing, including, but not limited to, a drawworks 40 via a kelly joint 41, swivel 44 and line 46 through a pulley 48. In some embodiments, the surface equipment may include a top drive (not shown).

Figure 2:
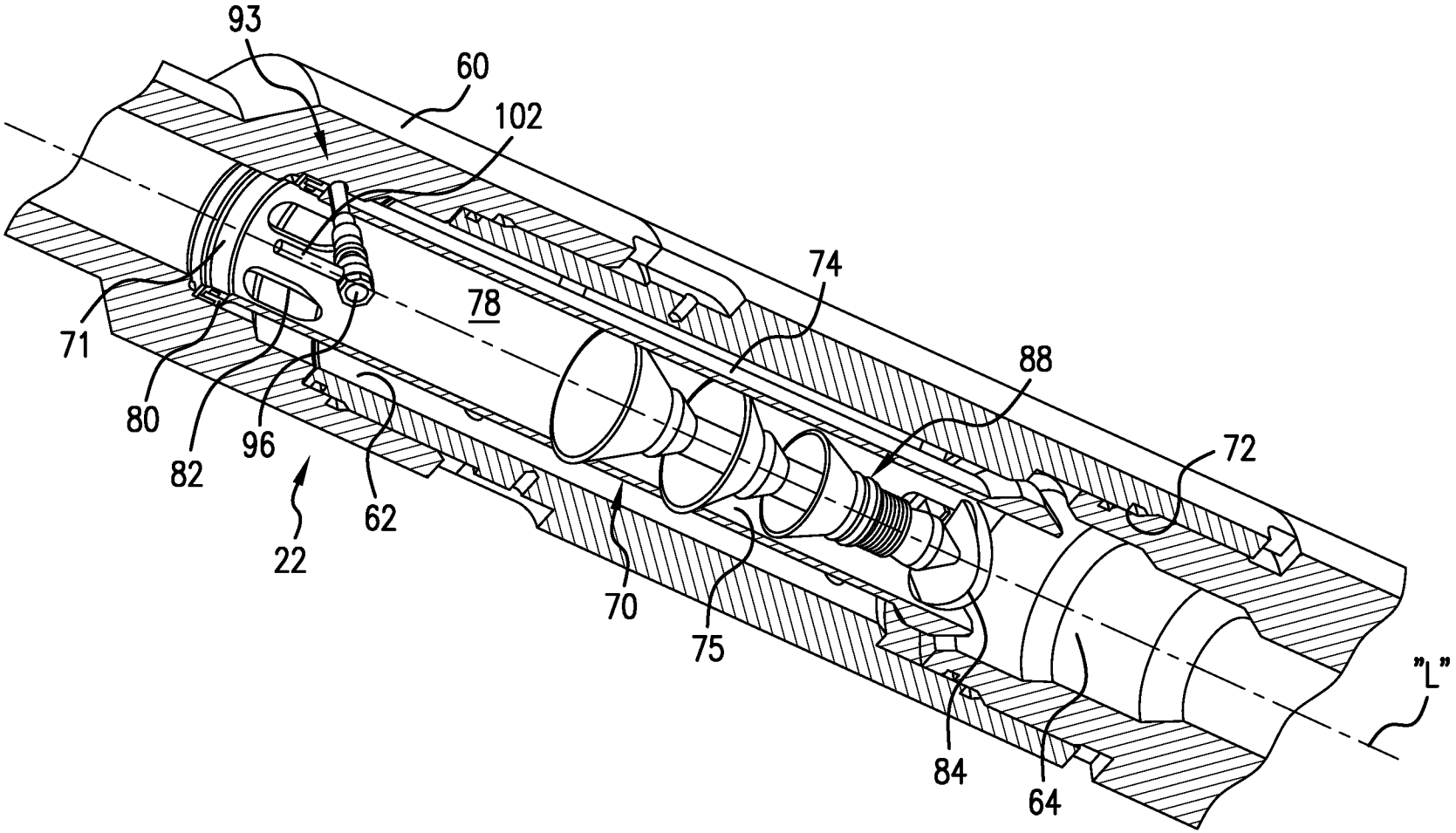
FIG. 2 depicts a partially cut-away view of the plug release system, in accordance with an aspect of an exemplary embodiment.
Figure 3:
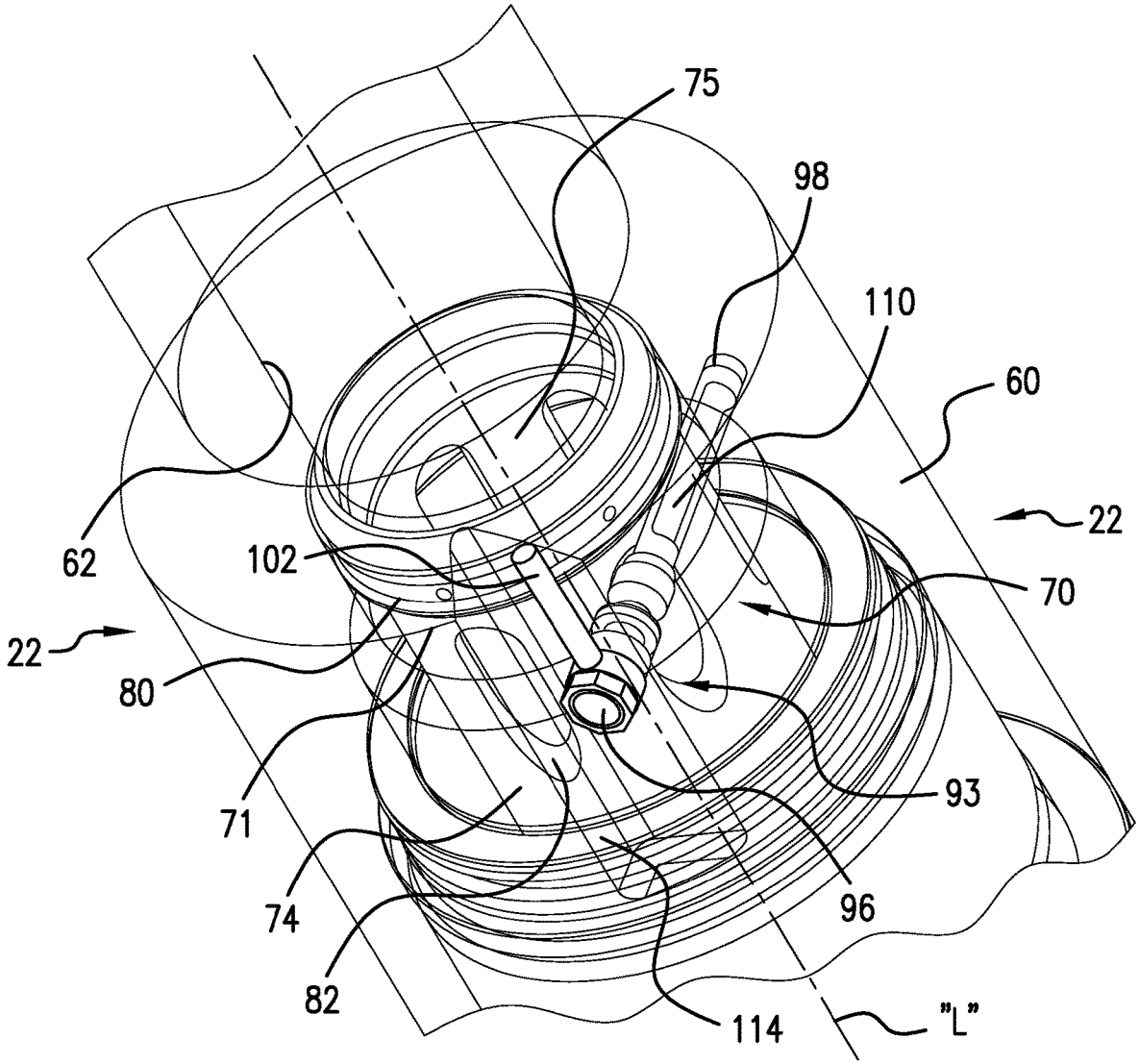
FIG. 3 depicts a glass view of a tubular including the plug release system of FIG. 2, in accordance with an aspect of an exemplary embodiment.
Figure 4:
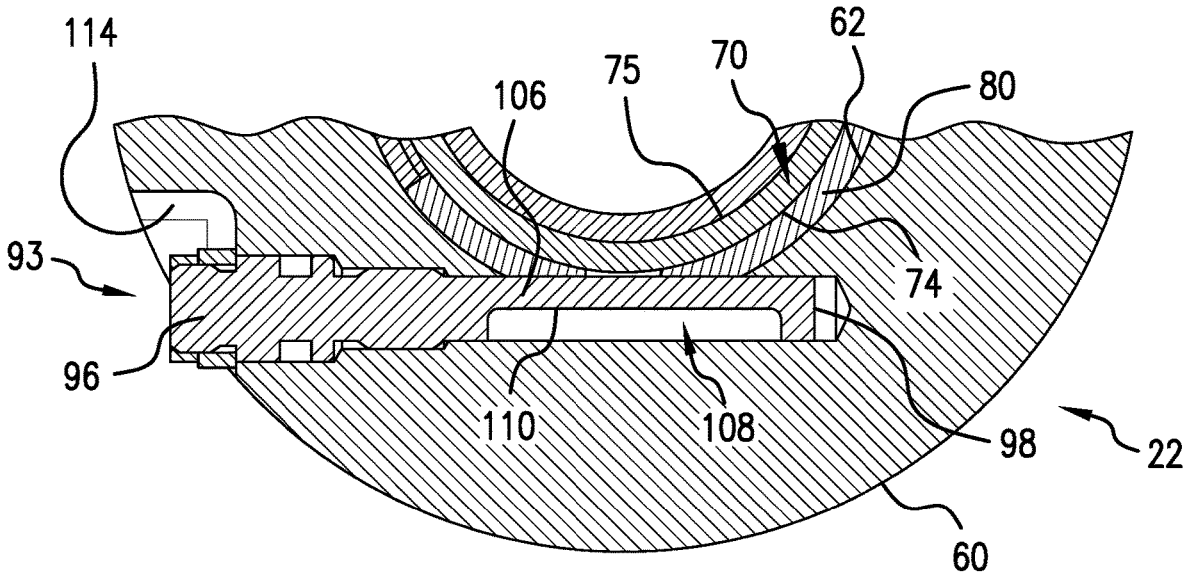
FIG. 4 depicts a cross-sectional axial end view of the tubular of FIG. 2, in accordance with an aspect of an exemplary embodiment.

Referring to FIGS. 2-4, each tubular member 22 includes an outer surface 60 and an inner surface 62 that defines a flow bore 64 having a central longitudinal axis "L". A sleeve 70 is arranged in flow bore 64. Sleeve 70 may shift along central longitudinal axis "L" and includes a first end 71 and an opposing second end 72. Sleeve 70 also includes an outer surface 74 and an inner surface 75 that defines a plug or dart retention zone 78. A radially outwardly projecting annular lip 80 is provided proximate to first end 71. A plurality of openings, one of which is indicated at 82, are arranged below radially outwardly projecting annular lip 80. A plug support 84 is pivotally mounted at second end 72. A dart 88 is supported on plug support 84 in plug retention zone 78.

In accordance with an exemplary embodiment, a release mechanism 93 selectively retains sleeve 70 in a dart retention configuration such as shown in FIG. 2. Release mechanism 93 extends radially across flow bore 64 spaced from central longitudinal axis "L". More specifically, release mechanism 93 does not bisect or otherwise pass through central longitudinal axis "L". Release mechanism 93 includes a first end portion 96 and a second end portion 98. First end portion 96 projects radially outwardly of outer surface 60 which second end portion 98 is rotatably supported in tubular member 22 between outer surface 60 and inner surface 62. First end portion 96 supports a handle member 102 that projects radially outwardly of release mechanism 93.

Figure 5:
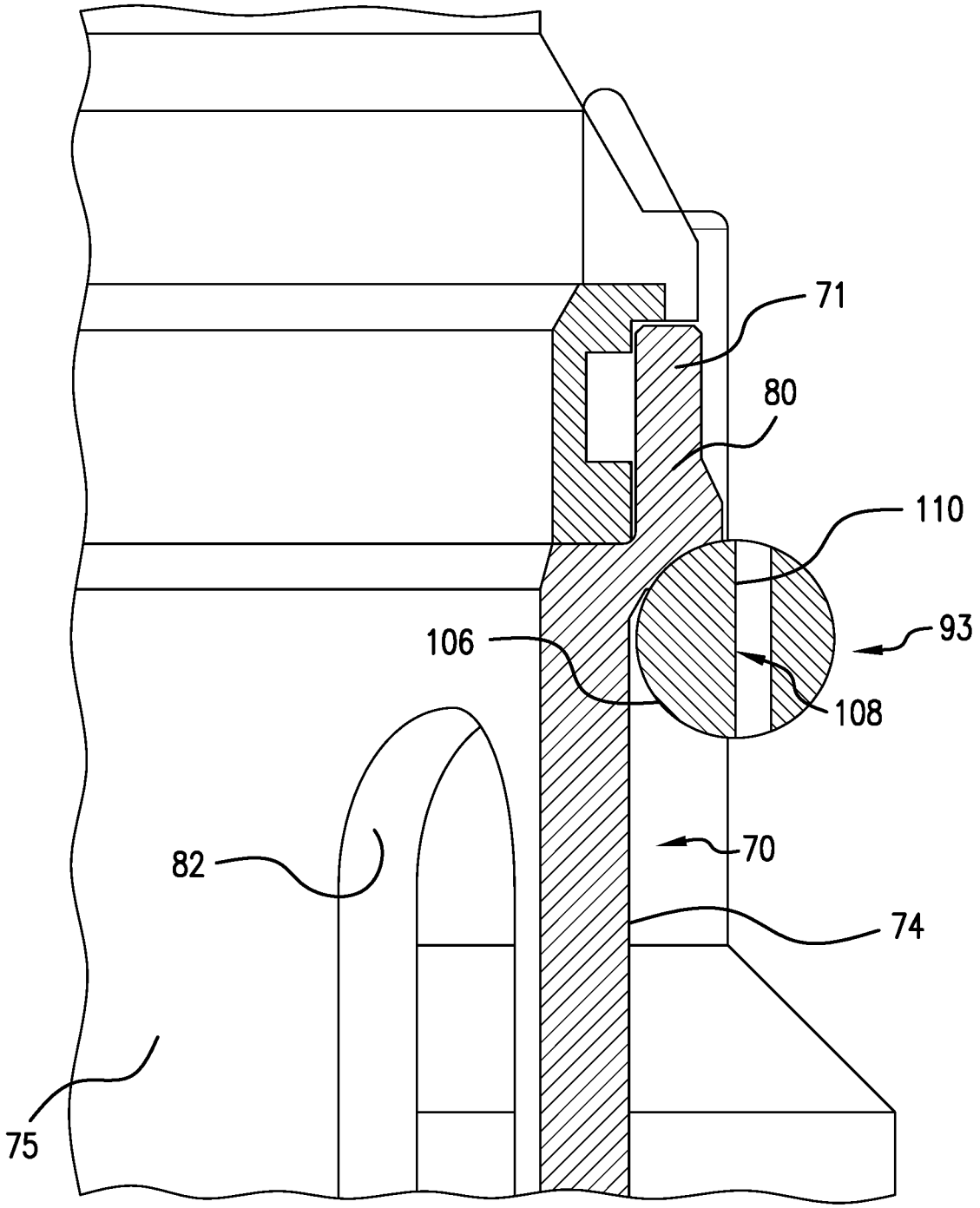
FIG. 5 depicts a cross-sectional side view of the tubular of FIG. 4, in accordance with an aspect of an exemplary embodiment.
Figure 7:
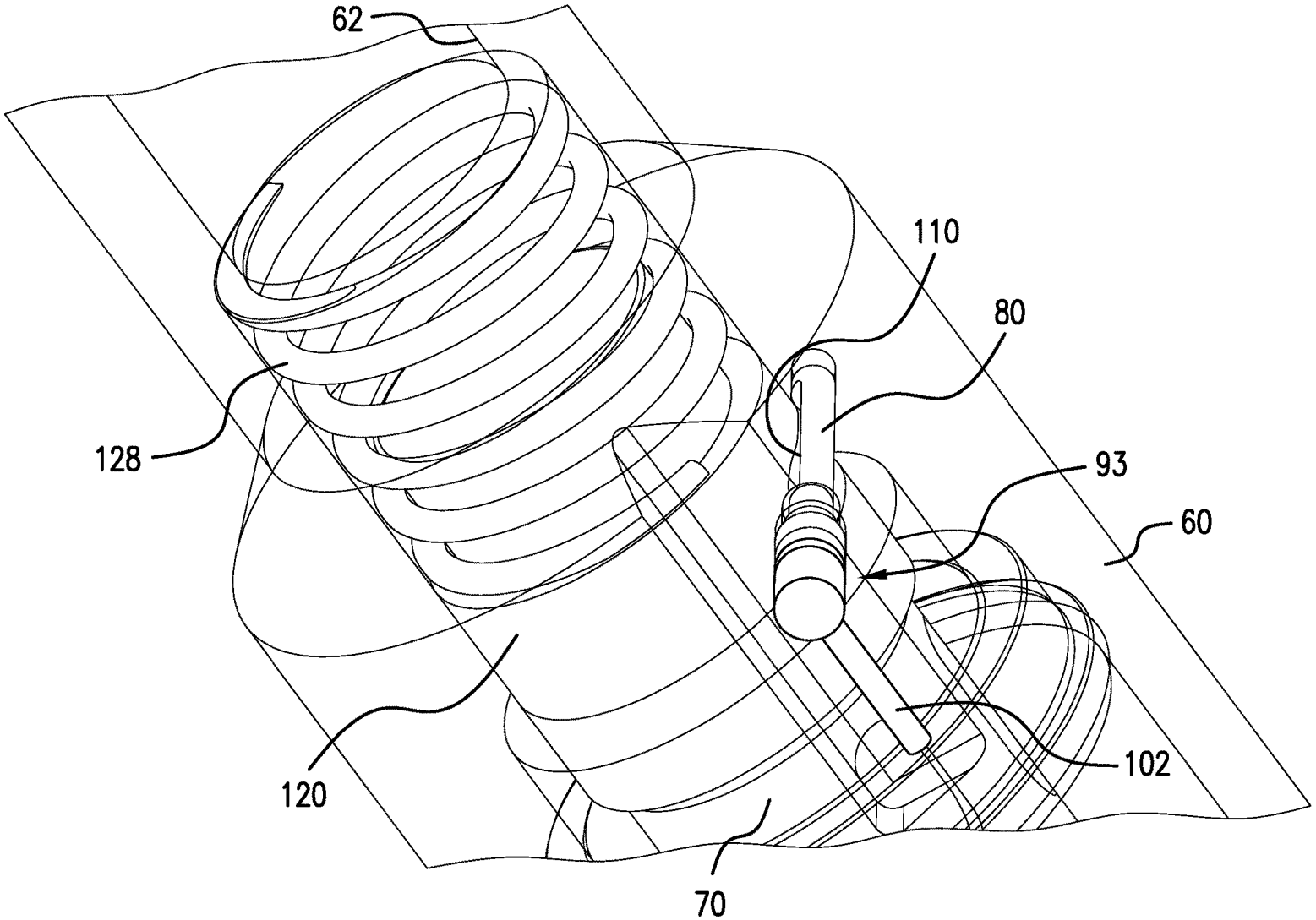
FIG. 7 depicts the plug release system of FIG. 6 in a plug release configuration, in accordance with an aspect of an exemplary embodiment.

In accordance with an exemplary embodiment, release mechanism 93 includes a generally circular cross section that defines, at least in part, a sleeve retention portion 106 and a sleeve release portion 108 as shown in FIG. 5. Sleeve release portion 108 takes the form of a flat surface formed in release mechanism 93. Release mechanism 93 rotates from a sleeve retention position (FIG. 5) to a sleeve release position such as shown in FIG. 7. Release mechanism 93 rotates, from the sleeve retention position, about 180°, to the sleeve release position. Once in the sleeve release position, a flow rate of fluid along flow bore 64 may be controlled to force sleeve 70 to axially shift in tubular 22.

Figure 6:
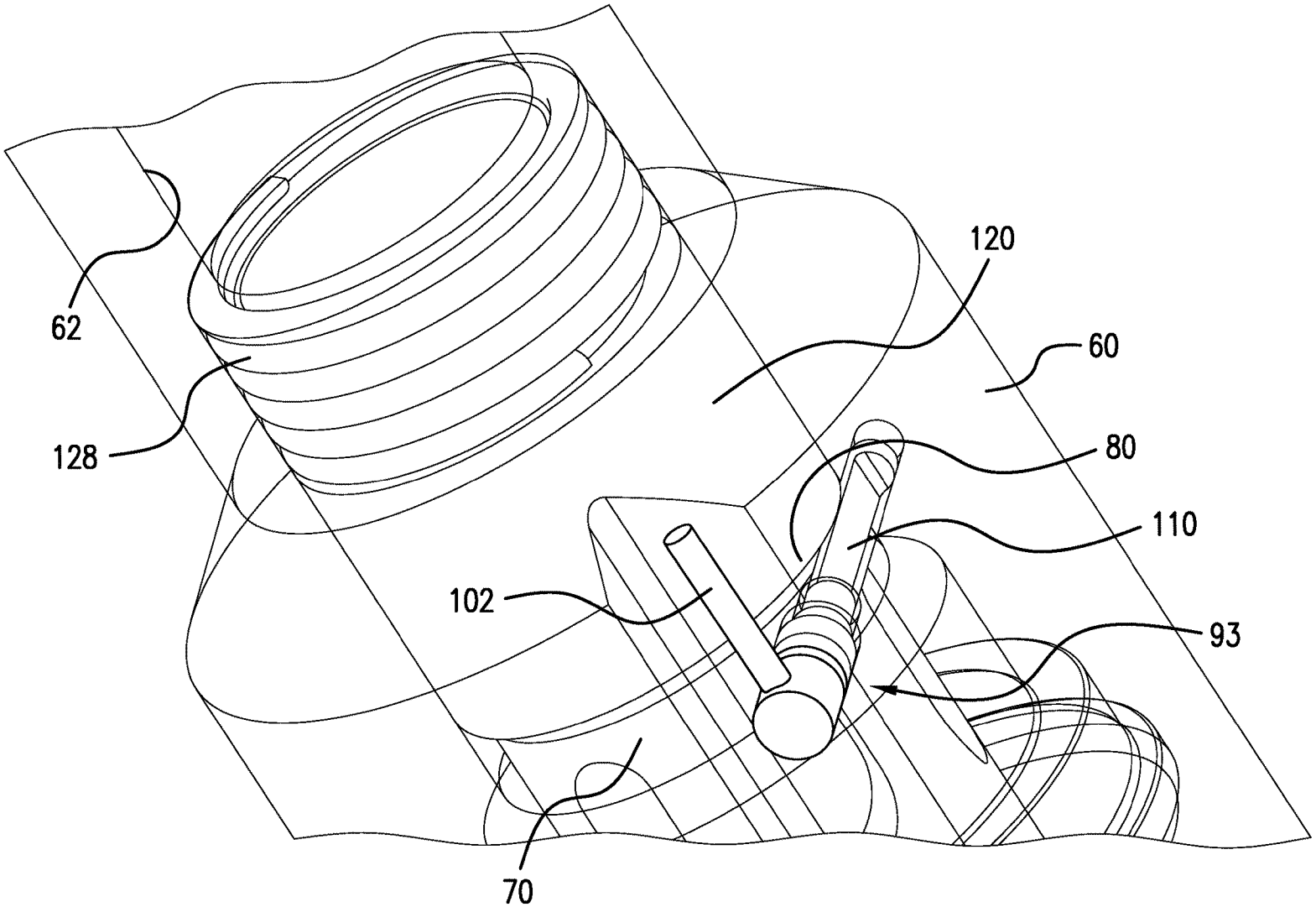
FIG. 6 depicts a glass view of a plug release system shown in a plug retention configuration, in accordance with another aspect of an exemplary embodiment.
Figure 8:
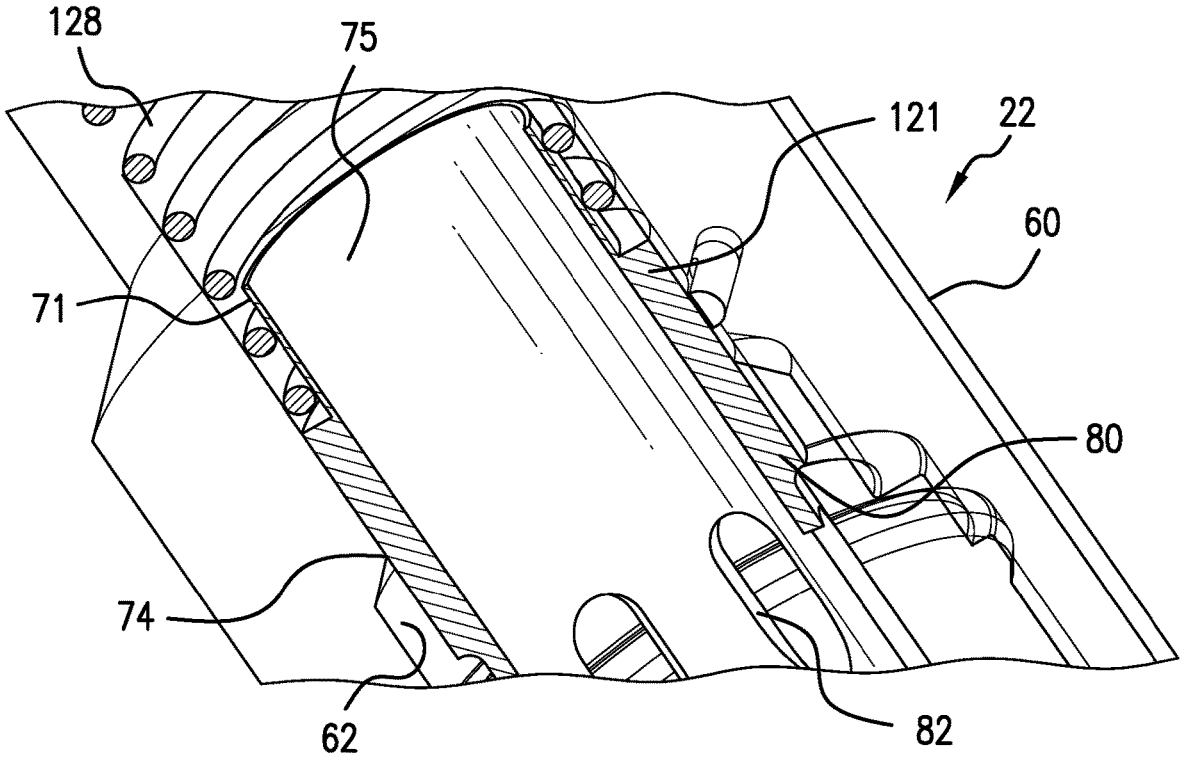
FIG. 8 depicts a cross-sectional side view of the plug release system of FIG. 7, in accordance with an aspect of an exemplary embodiment.

In an exemplary aspect, tubular 22 includes a recess 114 formed in outer surface 60. Recess 114 houses handle member 102 in both the sleeve retention position and the sleeve release position. In another exemplary aspect depicted in FIGS. 6-8, radially outwardly extending lip 80 is spaced from first end 71 by an indicator zone 120. Indicator zone 120 represents a lockout that prevents an operator from moving release mechanism 93 from the sleeve release position back to the sleeve retention position. In this manner, after releasing sleeve 70, the operator may confirm that sleeve 70 has shifted and dart 88 has been launched. In yet a further exemplary aspect, a spring 128 may provide a biasing force that urges sleeve 70 to shift along flow bore 64 when release mechanism 93 is moved to the sleeve release position.

At this point, it should be understood that the exemplary embodiments provide a system for releasing a plug/dart that has an expanded contact area over legacy systems, as well as provides an operator with confirmation that a sleeve has shifted, and the dart launched. Further, the release mechanism is supported at both ends and may be readily maintained without the need to disassembly the supporting tubular. Finally, the use of a curvilinear surface to support the sleeve reduces wear and stress when being run into a wellbore.

Set forth below are some embodiments of the foregoing disclosure:

Embodiment 1. A plug release system comprising: a tubular member including an outer surface and an inner surface defining a flow bore having a central longitudinal axis; a sleeve positioned in the flow bore, the sleeve including a first end including a radially outwardly extending annular lip, and a second end; and a release mechanism rotatably mounted in the tubular member radially offset from the central longitudinal axis, the release mechanism including a sleeve support surface that selectively engages the radially extending annular lip, the release mechanism being rotatable between a first position wherein the sleeve maintains a plug in a retained configuration and a second position, wherein the sleeve releases the plug into the tubular member.

Embodiment 2. The plug release system according to any prior embodiment, wherein the release mechanism includes a first end portion positioned radially outwardly of the outer surface and a second end portion positioned between the inner surface and the outer surface, the release mechanism extending across a portion of the flow bore.

Embodiment 3. The plug release system according to any prior embodiment, wherein the first end portion includes a handle member.

Embodiment 4. The plug release system according to any prior embodiment, wherein the outer surface of the tubular member includes a recess, the handle member being arranged in the recess.

Embodiment 5. The plug release system according to any prior embodiment, wherein the sleeve includes an outer surface portion and an inner surface portion defining a plug retention zone.

Embodiment 6. The plug release system according to any prior embodiment, wherein the release mechanism extends between the inner surface of the tubular member and the outer surface portion of the sleeve.

Embodiment 7. The plug release system according to any prior embodiment, further comprising: a plug support pivotally mounted at the second end of the sleeve.

Embodiment 8. The plug release system according to any prior embodiment, further comprising: a plug arranged on the plug support.

Embodiment 9. The plug release system according to any prior embodiment, wherein the release mechanism is rotatable about an axis that extends through the outer surface and the inner surface.

Embodiment 10. The plug release system according to any prior embodiment, wherein the release mechanism includes a substantially circular cross-section having a flat zone.

Embodiment 11. A resource exploration and recovery system comprising: a surface system; and a subsurface system including a tubular member string extending from the surface system, the tubular member string including at least one tubular member having an outer surface and an inner surface defining a flow bore having a central longitudinal axis; a sleeve positioned in the flow bore, the sleeve including a first end including a radially outwardly extending annular lip, and a second end; and a release mechanism rotatably mounted in the tubular member radially offset from the central longitudinal axis, the release mechanism including a sleeve support surface that selectively engages the radially extending annular lip, the release mechanism being rotatable between a first position wherein the sleeve maintains a plug in a retained configuration and a second position, wherein the sleeve releases the plug into the tubular member.

Embodiment 12. The resource exploration and recovery system according to any prior embodiment, wherein the release mechanism includes a first end positioned radially outwardly of the outer surface and a second end positioned between the inner surface and the outer surface, the release mechanism extending across a portion of the flow bore.

Embodiment 13. The resource exploration and recovery system according to any prior embodiment, wherein the first end includes a handle member.

Embodiment 14. The resource exploration and recovery system according to any prior embodiment, wherein the outer surface of the tubular member includes a recess, the handle member being arranged in the recess.

Embodiment 15. The resource exploration and recovery system according to any prior embodiment, wherein the sleeve includes an outer surface portion and an inner surface portion defining a plug retention zone.

Embodiment 16. The resource exploration and recovery system according to any prior embodiment, wherein the release mechanism extends between the inner surface of the tubular member and the outer surface portion of the sleeve.

Embodiment 17. The resource exploration and recovery system according to any prior embodiment, wherein the release mechanism includes a substantially circular cross-section having a flat zone.

Embodiment 18. A method of releasing a plug into a tubular member string comprising: manipulating a release mechanism to disengage a sleeve support surface from a radially outwardly extending annular lip on a sleeve positioned in a flow bore of a tubular member; releasing the sleeve to shift from a plug support position to a plug release position; and freeing a plug to pass into the tubular member string.

Embodiment 19. The method according to any prior embodiment, wherein manipulating the release mechanism includes rotating the release mechanism from a first, sleeve retention position, wherein a handle member of the release mechanism is stowed in a recess of the tubular member, to a second, sleeve release position, wherein the handle member of the release mechanism is stowed in the recess of the tubular member.

Embodiment 20. The method according to any prior embodiment, further comprising: indicating that the sleeve has released by inhibiting travel of the release mechanism.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A plug release system comprising:

a tubular member including an outer surface and an inner surface defining a flow bore having a central longitudinal axis;

a sleeve positioned in the flow bore, the sleeve including a first end including a radially outwardly extending annular lip, and a second end; and a release mechanism rotatably mounted in the tubular member radially offset from the central longitudinal axis, the release mechanism including a first end portion positioned radially outwardly of the outer surface and a second end portion positioned between the inner surface and the outer surface, and a sleeve support surface that selectively engages the radially extending annular lip, the release mechanism extending across a portion of the flow bore and being rotatable between a first position wherein the sleeve maintains a plug in a retained configuration and a second position, wherein the sleeve releases the plug into the tubular member.

2. The plug release system according to claim 1, wherein the first end portion includes a handle member.

3. The plug release system according to claim 2, wherein the outer surface of the tubular member includes a recess, the handle member being arranged in the recess.

4. The plug release system according to claim 1, wherein the sleeve includes an outer surface portion and an inner surface portion defining a plug retention zone.

5. The plug release system according to claim 4, wherein the release mechanism extends between the inner surface of the tubular member and the outer surface portion of the sleeve.

6. The plug release system according to claim 4, further comprising: a plug support pivotally mounted at the second end of the sleeve.

7. The plug release system according to claim 6, further comprising: a plug arranged on the plug support.

8. The plug release system according to claim 1, wherein the release mechanism is rotatable about an axis that extends through the outer surface and the inner surface.

9. The plug release system according to claim 1, wherein the release mechanism includes a substantially circular cross-section having a flat zone.

10. A resource exploration and recovery system comprising:

a surface system; and a subsurface system including a tubular member string extending from the surface system, the tubular member string including at least one tubular member having an outer surface and an inner surface defining a flow bore having a central longitudinal axis;

a sleeve positioned in the flow bore, the sleeve including a first end including a radially outwardly extending annular lip, and a second end; and a release mechanism rotatably mounted in the tubular member radially offset from the central longitudinal axis, the release mechanism including a first end portion positioned radially outwardly of the outer surface and a second end portion positioned between the inner surface and the outer surface, and a sleeve support surface that selectively engages the radially extending annular lip, the release mechanism extending across a portion of the flow bore and being rotatable between a first position wherein the sleeve maintains a plug in a retained configuration and a second position, wherein the sleeve releases the plug into the tubular member.

11. The resource exploration and recovery system according to claim 10, wherein the first end includes a handle member.

12. The resource exploration and recovery system according to claim 11, wherein the outer surface of the tubular member includes a recess, the handle member being arranged in the recess.

13. The resource exploration and recovery system according to claim 10, wherein the sleeve includes an outer surface portion and an inner surface portion defining a plug retention zone.

14. The resource exploration and recovery system according to claim 13, wherein the release mechanism extends between the inner surface of the tubular member and the outer surface portion of the sleeve.

15. The resource exploration and recovery system according to claim 10, wherein the release mechanism includes a substantially circular cross-section having a flat zone.

16. A method of releasing a plug into a tubular member string comprising:

rotating the release mechanism from a first, sleeve retention position, wherein a handle member of the release mechanism is stowed in a recess of the tubular member, to a second, sleeve release position, wherein the handle member of the release mechanism is stowed in the recess of the tubular member to disengage a sleeve support surface from a radially outwardly extending annular lip on a sleeve positioned in a flow bore of a tubular member;

releasing the sleeve to shift from a plug support position to a plug release position; and freeing a plug to pass into the tubular member string.

17. The method of claim 16, further comprising: indicating that the sleeve has released by inhibiting travel of the release mechanism.

* * * * *